US006156156A

United States Patent [19]

Rousu et al.

[11] Patent Number: 6,156,156

[45] Date of Patent: Dec. 5, 2000

[54] METHOD OF PRODUCING PULP USING SINGLE-STAGE COOKING WITH FORMIC ACID AND WASHING WITH PERFORMIC ACID

[75] Inventors: Pasi Rousu; Päivi Rousu; Esa Rousu, all of Oulu, Finland

[73] Assignee: Chempolis Oy, Oulu, Finland

[21] Appl. No.: 09/297,546

[22] PCT Filed: Nov. 5, 1997

[86] PCT No.: PCT/FI97/00671

§ 371 Date: May 3, 1999

§ 102(e) Date: May 3, 1999

[87] PCT Pub. No.: WO98/20198

PCT Pub. Date: May 14, 1998

[30] Foreign Application Priority Data

Nov. 6, 1996 [FI] Finland ..... 964466

[51] Int. Cl.[7] ..... D21C 3/04

[52] U.S. Cl. ..... 162/76; 162/78

[58] Field of Search ..... 162/76, 70, 60

[56] References Cited

FOREIGN PATENT DOCUMENTS 250 422 3/1986 European Pat. Off. ..... 162/76

821614 4/1981 U.S.S.R. ..... 162/76

WO8605529 9/1986 WIPO .

OTHER PUBLICATIONS

1995 Pulping Conference Bok 2, Sheraton Chicago, Chicago, IL, Oct. 1–5, Seisto, A, et al., Grass Pulp for Papermaking by the Peroxyformic Acid Pulping Method, 1995 Pulping Conference Chicago 1. Oct.–5. Oct. 1995, pp. 487–494.

The 8$^{th}$ International Symposium on Wood and Pulping Chemistry, Jun. 6–9, 1995 Helsinki, Finland. Seisto, A. et al., "Milox Pulping of Agricultrural Plants", International Symposium on Wood and Pulping Chemistry, Helsinki 6.Jun.–9.Jun. 1995, pp. 407–414.

*Primary Examiner*—Steve Alvo

*Attorney, Agent, or Firm*—Alston & Bird LLP

[57] ABSTRACT

The invention relates to a method of producing pulp with a high brightness using single-stage cooking with formic acid, washing with performic acid and bleaching with oxidizing bleaching chemicals. In performic acid washing, the rapid formation and rapid reactions of performic acid (HCOOOH) are utilitized for modification of residual lignin. The method of the invention provides an ISO brightness exceeding 90% without a chlorine chemicals. The method can be applied to both herbaceous plants and wood.

15 Claims, 1 Drawing Sheet

FIG.
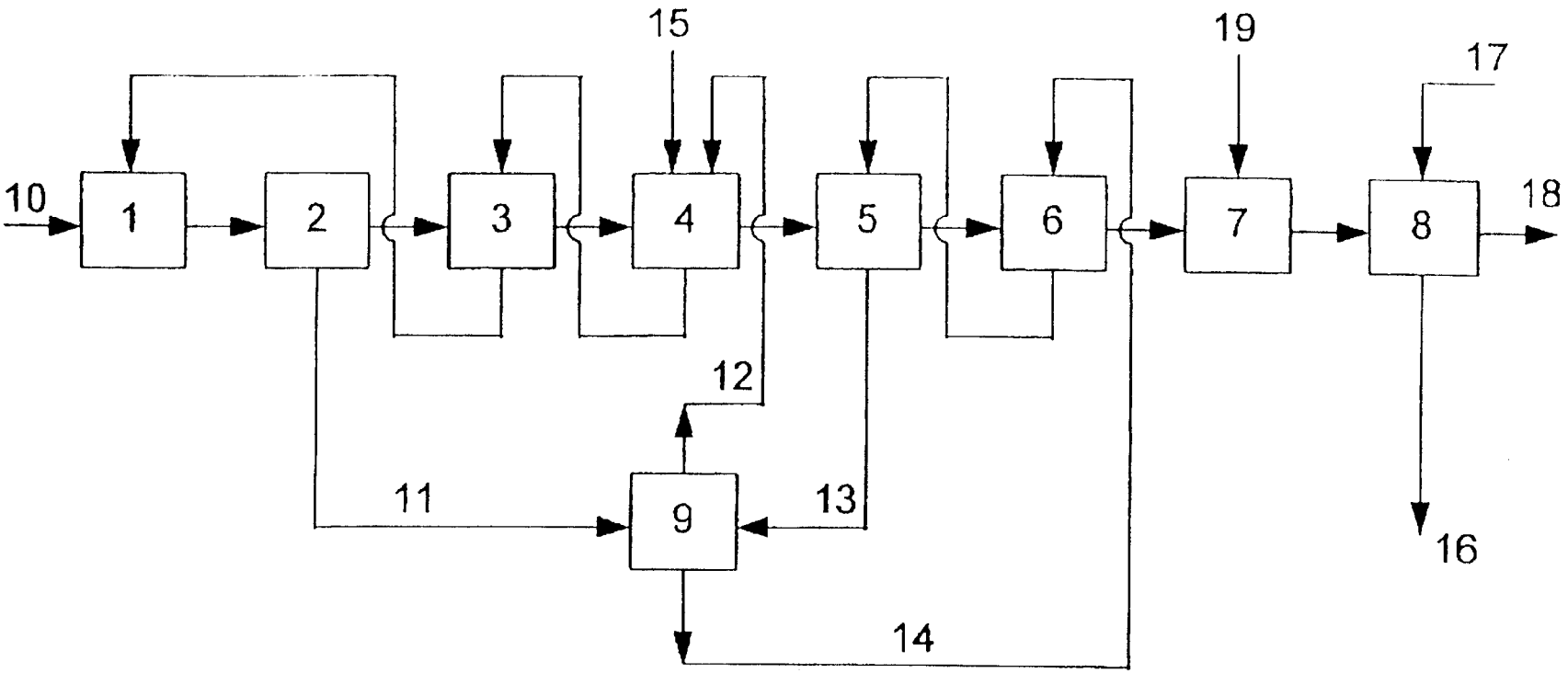

METHOD OF PRODUCING PULP USING SINGLE-STAGE COOKING WITH FORMIC ACID AND WASHING WITH PERFORMIC ACID

The invention relates to a method of producing pulp with a high brightness using single-stage cooking with formic acid, washing with performic acid and bleaching with oxidizing bleaching chemicals. In performic acid washing, the rapid formation and rapid reactions of performic acid (HCOOOH) are utilized for modification of residual lignin. The method of the invention provides an ISO brightness exceeding 90% without chlorine chemicals. The method can be applied to both herbaceous plants and wood.

The production of pulp from herbaceous plants (common reed, goat's rue) is described in the publication Laamanen J. & Sundqvist, J., Agrokuidun tuotanto ja käyttö Suomessa [Production and use of agrofibre in Finland]. Final report on the study, Part III, Vaihtoehtoiset kuidutusmenetelmät [Alternative defibration methods], Jokioinen 1996, Agricultural Research Centre, Publication 5 series A, p. 69 to 88. Common reed is cooked using single-stage, two-stage and three-stage Milox methods. In single-stage Milox cooking, a mixture of formic acid and hydrogen peroxide at a maximum temperature of 80° C. is used. In the two-stage method, the grass is first cooked in formic acid alone and then in a mixture of formic acid and hydrogen peroxide. The three-stage method first comprises a peroxy formic acid cooking stage, followed by two-stage Milox cooking.

After Milox cooking the pulps are bleached with alkaline peroxide. The publication states that the common reed pulp reaches its target brightness 80 to 85% with alkaline peroxide alone, but, in spite of its low kappa number, uses more peroxide than Milox pulp produced from e.g. birch chips. The yield of the bleaching is stated to be quite low too, about 80%. The best brightness 83.4% was reached using five peroxide stages and a peroxide consumption of 3.3% calculated on pulp.

As to cooking goat's rue, it is stated that goat's rue Milox pulp can be bleached to a brightness exceeding 85% with alkaline peroxide alone and that peroxide consumption is in the same range as with common reed Milox pulp (4%). Four peroxide stages have provided an 84.5% brightness with an about 3% peroxide consumption calculated on pulp.

The summary of the publication states that the best results, both when using common reed and when using goat's rue, have been achieved by a two-stage Milox method first involving cooking in formic acid alone and then in a mixture of formic acid and hydrogen peroxide at 80° C. for 3 hours.

Brightness values exceeding 90% have not been reached with the above methods.

Finnish Patent 74750 discloses a method of producing bleached pulp from lignin-containing cellulose raw material, such as softwood or hardwood chips. Organic peroxo acids, such as peroxo acids derived from formic acid, are used as defibration reagents. The defibration reagent can be produced by e.g. adding hydrogen peroxide to formic acid. An alkaline solution containing hydrogen peroxide is used for bleaching. In the example of the patent, the highest achieved brightness was 90.3%. The hydrogen peroxide amounts used were, however, relatively high, preferably 5 to 20% calculated on raw material, and the cooking times were long.

It is known from the publication Sundqvist J., Chemical Pulping Based on Formic Acid—Summary of Milox Research, Paper and Timber 78 (1996)3, p. 92 to 95, to feed hydrogen peroxide into the first and third cooking stages of multi-stage formic acid cooking. In the method, the chips are treated with formic acid and a small amount of hydrogen peroxide at 60 to 80° C. in the first stage. The main delignification is carried out in the second stage at a temperature of 90 to 100° C. In the third stage, the pulp is cooked in a solution containing formic acid and hydrogen peroxide. In all three stages, the formic acid content in the cooking solution exceeds 80% and the cooking times in each stage vary between 1 and 3 hours. Liquid circulation is planned such that after the cooked pulp has been washed with acid, the acid enters the third stage, from where it enters the first cooking stage, and from there the second cooking stage, and then goes further to regeneration. This way hydrogen peroxide and performic acid are used up by the oxidation of dissolved lignin, and peracid is subjected to impurities decomposing hydrogen peroxide and peracid and causing extra peroxide consumption. The returned acids cause the kappa number of the pulp to remain higher than that of pulp cooked using pure acids, resulting in increased hydrogen peroxide consumption.

In the method of the invention, the drawbacks of said known methods, i.e. primarily insufficient brightness of non-wood materials, high hydrogen peroxide consumption, and high investment costs, have been eliminated by utilizing the good delignification characteristics of formic acid at temperatures exceeding 85° C., and preferably at a temperature higher than the normal boiling point of formic acid, and by utilizing the rapid formation and rapid reactions of performic acid with residual lignin alone. In addition, the number of formic acid ccoking stages can be reduced from two or three-stage to single-stage. In the method of the invention, the kappa number (20 to 30) of the pulp after defibration, washing with performic acid and washing with water is sufficient to achieve the final target brightness (more than 90%). The pulp can be bleached in fewer stages than before and to a higher brightness than before without chlorine compounds. High brightness is achieved by simultaneously maintaining good viscosity.

The invention relates to a method based on single-stage formic acid cooking for producing pulp with a high brightness, the method comprising the stages of:

(a) defibrating cellulose raw material in single-stage cooking with formic acid, possibly together with other organic acids, (b) removing cooking liquor from the defibrated pulp and washing the pulp with formic acid, (c) removing acid/acids from the pulp, and (d) bleaching the pulp by using oxidizing bleaching chemicals.

The method is characterized in that the formic acid washing in stage (b) comprises as the last acid washing stage a stage (b1) in which the pulp, free from cooking liquor and in a medium or high consistency state, is washed with formic acid containing performic acid produced in situ and possibly other peracids.

In step (a) the cellulose raw material is defibrated with single-stage formic acid cooking. Formic acid cooking is carried out at a temperature exceeding 85° C., preferably at a temperature between 105 and 135° C., most preferably at a temperature between 110 and 125° C. The cooking time of herbaceous plants can vary between 15 and 80 minutes, preferably between 20 and 40 min. A cooking time typical of herbaceous plants is e.g. 20 min. A cooking time typical of hardwood material is 25 to 90 min. The method is also suitable for straw and other fibre-based agricultural waste. The time during which the temperature is raised to reaction temperature, including possible absorption time of cooking chemicals, is 30 to 70 min.

A short single-stage cooking time with formic acid alone allows the use of the most preferable continuous screw reactor technique for grasses and the use of the continuous Kamyr digester and the Super batch digester for wood chips.

In addition to formic acid, other organic acids can also be used, such as acetic acid, a small amount of which is inherently formed in the process. As a cooking reagent, acetic acid is not, however, as efficient as formic acid.

Cooking liquor is removed from the pulp defibrated in stage (b) by leading it to a screw or pressure press, a vacuum filter, or the like. The removed cooking liquor contains the bulk of the dissolved lignin. Pulp consistency in said pressing or filtering stage can be 20 to 55%, preferably 30 to 50%.

Typically the pulp is then led to an acid washing stage in which more cooking liquor is removed. The pulp is typically acid washed with formic acid, preferably as a counter-current wash in such a way that the acid used for the wash is achieved as return acid from the performic acid washing stage (b1). The formic acid used in the performic acid washing stage, in turn, is preferably achieved from the regeneration of the cooking liquor. The acid removed from the washing stage is preferably recycled to the formic acid cooking in stage (a).

The concentration of the formic acid used in the washing stages is typically 65 to 99%.

The pulp is washed and pressed in several stages, typically 2 to 6 stages, preferably in pressure washers. Before treatment with performic acid, i.e. the last acid washing stage, pulp consistency is high, typically 10 to 50%, preferably 20 to 35% dry matter.

When the pulp has been processed as described above and is in a medium or high consistency state, lignin, hemicellulose, fats and metals have been removed from it. The removal of these intensifies the reaction of hydrogen peroxide with formic acid to be performed in the next stage, i.e. the formation of peracids, thus enhancing the reactions of residual lignin. Only residual lignin, and a very small content, is present of the lignin in the pulp processed in this way. Otherwise the performic acid of stage (b1) would be taken up by unnecessary reactions and the hydrogen peroxide would decompose or would, together with metals, cause formation of radicals and a decrease in viscosity.

It should also be noted that fats and fatty acids use performic acid to form epoxides. The formation of these can be reduced as formic acid as such is able to hydrolyze fats and fatty acids which, in accordance with the present invention, are separated with the cooking liquor, and peracid/hydrogen peroxide is only used in pulp free from fatty acids. If the performic acid performs reactions unnecessary to the process, hydrogen peroxide consumption rises remarkably high, as in previous methods. This drawback has been eliminated in the method of the invention by treating the pulp in the above stages (a) and (b) in such a way that only a small amount of residual lignin remains for the performic acid reaction.

The significance of acid washings to vegetable nutrients is important since all nutrients arriving at the mill together with the plants can be transferred to the cooking liquor during acid cooking. The lignin, concentrated in connection with the regeneration of the cooking liquor during evaporation, and the hemicellulose phase comprise the nutrients, and the acid is evaporated to be recycled. The nutrients can be utilized either as fuel ash fertilizers for non-wood fields or as nutrient salts in hemicellulose fermentation.

In stage (b1), the medium or high consistency pulp, free from cooking liquor, is treated with formic acid containing performic acid prepared in situ. The performic acid is prepared immediately before use in situ e.g. by adding hydrogen peroxide to formic acid. In practical implementations of the method of the invention, the performic acid treatment is preferably performed in connection with acid washing as the last acid washing stage in a peracid washer.

The formic acid needed in performic acid washing is preferably obtained from the regeneration of the cooking acid as a pure regenerated acid. Residual peracid is preferably led in counter current to the previous washing stage. The pulp exiting the last acid washing, i.e. the treatment with performic acid, is pressed to as high a dry matter content as possible, whereby the peracid remaining in the pulp finishes its reaction and the pressed cooking liquor is used in previous washing stages and from there in counter current as cooking liquor.

The amount of hydrogen peroxide used in the preparation of performic acid is 0.01 to 1.5%, preferably 0.2 to 1.0%, calculated on the amount of cellulose raw material. The formation and reaction time of peracid is 1 to 20 min, preferably 5 to 15 min. The reaction time of peracid is suitable for the treatment times of typical washers and compressors. Pulp consistency is 10 to 50%, preferably 20 to 35%, and treatment temperature is 50 to 90° C., preferably 60 to 80° C. The hydrogen peroxide is added to concentrated formic acid or to the pulp containing formic acid. The typical concentration of formic acid is 65 to 99%, preferably 70 to 90%.

The formation of performic acid in concentrated formic acid is a rapid reaction. As early as 2 to 5 minutes from the feed of hydrogen peroxide to e.g. 70° C. formic acid, the performic acid concentration has reached its peak. When hydrogen peroxide and the formed performic acid are fed in accordance with the present invention to medium or high consistency pulp in the washing and pressing stage, the amount of performic acid relative to the amount of residual lignin is at its highest. The performic acid can then optimally react with the residual lignin and hydrogen peroxide consumption is minimized. The residual lignin can be optimally modified for bleaching.

The performic acid treatment time is usually the treatment time of a typical washing stage.

In stage (c), acid is removed from the pulp in the simplest way by washing with water at an elevated temperature of 80 to 120° C. and/or using a vacuum. Acid is usually removed in several stages. A conventional equipment is used for the washing. In washing the pulp with water, the amount of water used relative to the amount of pulp is so small that the acid obtained from the water wash is an acid concentrated in several counter current stages and having a concentration of 30 to 50%.

Washing the pulp with water to recover acids in stage (c) is easy, since lignin, hemicellulose and fatty acids have been well washed from the pulp in the acid washing stage (b). Filtration and water removal is therefore rapid. In contrast, when cooking herbaceous plants with alkaline cooking chemicals, foaming and fine silicate crystals disturb the filtration of water washings. Acid cooking chemicals do not show similar disadvantages. In stage (d), the pulp is bleached by using oxidizing bleaching chemicals. Bleaching is preferably performed by using alkaline hydrogen peroxide bleaching. Acid-hydrogen peroxide bleaching or other oxidizing bleaching sequences can also be used. Bleaching is preferably performed as pressure bleaching. A typical bleaching temperature is 80 to 125° C., preferably 100 to 115° C., and bleaching pressure 0.5 to 10 bar, preferably 2 to 5 bar. Bleaching time may vary between 25 and 120 min, preferably from 30 to 60 min. When only peroxide is used as bleaching chemical, the typical amount of hydrogen peroxide is 3 to 6.5%.

One pressure bleaching typically provides a high brightness, 81 to 86%, and two stages full brightness, 87.5 to 90%, three stages an ISO brightness exceeding 90%, and four stages an ISO brightness of 92%. One stage typically takes up 60 minutes of bleaching time at the temperature range of 100 to 110° C.

In the method of the invention it is essential that the viscosity of the pulp remain high. This can be affected by efficient mixing conditions for acid chemicals and by using small amounts of acid chemicals at a time. The viscosity of herbaceous plants usually remains naturally high owing to the silicates; contained by the plants, the silicates acting as natural protective agents for viscosity. Magnesium compounds and/or diethylene triamine penta acetic acid (DTPA) or ethylene diamine tetra acetic acid (EDTA) can be used as additional protective agents if needed, and these usually have to be added when using wood as raw material.

Maintaining viscosity in bleaching is highly dependent on pH. Bleaching is successful when pH is over 10.5, but when Mg compounds are used as stabilizers and pH is higher than 11, these compounds become precipitated with silicate and do no longer act efficiently as protective agents for viscosity.

Non-wood material contains large amounts of hemicellulose. In the method of the invention, the hemicellulose content is easily adjustable such that its too high concentrations do not disturb the production of cellulose or paper and do not impair the quality of paper causing weaker light-scattering properties, yellowing and brittleness, i.e. drawbacks that should be avoided particularly in high-grade paper.

Owing to its high brightness, the pulp produced by the method of the invention can be used for the production of high-grade paper.

BRIEF DESCRIPTION OF THE DRAWING

The FIGURE illustrates the method of the invention.

The process diagram shown in the attached FIGURE illustrates the operation of the method of the invention.

The process diagram shown in the FIGURE illustrates how raw material (10) is fed into a cooking reactor (1) in which the delignification chiefly takes place. As cooking chemical in said reaction, formic acid originating from counter-current acid washings (3) and further from peracid washing (4) is used. The cooking liquor (11) used is removed from pulp (2) by e.g. pressing. Peracid washing (4) is performed using acid from regeneration (12) and hydrogen peroxide (15) mixed either to said acid or directly to the pulp. The acid is removed from the pulp (5–6) e.g. by washing with water. Clean water for the washings (5–6) is obtained from regeneration (14) and the washing is performed in counter current. Bleaching chemicals (19) are fed into bleaching (7) and the bleached pulp (18) is washed (8) with water (17).

The following examples illustrate the method of the invention. In the examples, the ISO brightness was measured using the SCAN-C 11:75 standard, the kappa number was measured by the SCAN-C 1:77 standard and the viscosity in copper ethylene diamine solution by the SCAN-CM 15:88 standard.

EXAMPLE 1

(A) Pulp Defibration Stage

Non-fractionated reed canary grass (710 g, humidity 12.5%), cut up in 5 cm bits, was added to a pre-heated 10-liter pressure reactor. Formic acid (82%, 80° C.) was aspirated by a vacuum into the reactor so as to gain a formic acid (containing the humidity of the raw material) and common reed ratio of 4.5:1. The initial pressure in the reactor was raised by nitrogen to the value 1 bar. The temperature in the reactor was raised to 117° C. within 50 minutes, during which time the formic acid was absorbed in the raw material to be treated. The reactor was kept at 117° C. for 20 minutes.

Cooking liquor was removed from the pulp by vacuum filtration, and the pulp was washed with 85% formic acid in four stages. The pulp was then treated with performic acid/formic acid as the last acid washing stage. The performic acid was prepared immediately before use by adding 0.75% hydrogen peroxide, calculated on raw material, to the formic acid. Pulp consistency in the performic acid washing was 19%. The acid was washed from the pulps with warm water in multiple stages, resulting in a kappa number of 21.8 and a viscosity of 904. The washing and filtering stages lasted for a total of 7 minutes. The formation of peracid to its maximum concentration at 66° C. took 3 minutes.

(B) Bleaching of Pulp

Pulp (247 g dry matter, consistency 15%), which was prepared in the above manner and sorted, was fed into a bleaching reactor. Bleaching temperature was 92 to 102° C. (raised within 20 minutes), bleaching time 40 minutes and bleaching pressure 4 bar.

One bleaching stage resulted in an 81% ISO brightness with a viscosity of 774. No additives were used in the bleaching for the protection of viscosity. A second alkaline peroxide stage (87° C., 2h) resulted in a brightness of 87.6. A third alkaline pressure peroxide bleaching (105° C., 40 min, temperature raised within 20 min) resulted in a 90% ISO brightness and a fourth stage involving alkaline pressure peroxide bleaching (110° C., 30 min, temperature raised within 30 min) resulted in a 92.0% ISO brightness.

Total hydrogen peroxide consumption in the four bleaching stages was 6.3% of the amount of pulp with a pH range of 12 to 9.5.

EXAMPLE 2

A cooking reactor was filled with the same raw material in the same way as in example 1. Cooking temperature was 122° C. and cooking time 19 minutes (absorption time and temperature raising time was 40 min). In pulp peracid treatment, 1% hydrogen peroxide of the amount of pulp was used and the treatment temperature was 68° C. Pulp consistency in performic acid washing was 19%. The kappa number of the pulp after peracid washing and water washings was 25.0 and viscosity 916.

The pulp was bleached at 105° C. with an alkaline pressure peroxide (amount of peroxide 4% of amount of pulp), brightness being 86.6% ISO after the first stage and 90.0% ISO after the second stage (110° C., 2% hydrogen peroxide). Total hydrogen peroxide consumption in the two bleaching stages was 4.3% of the amount of pulp with a pH range of 10 to 10.5. Final viscosity was 792. Magnesium sulphate (0.5%) was used to protect viscosity.

EXAMPLE 3

Birch chips (dm 85%) were cooked in 82% formic acid at a temperature of 120° C. for 26 minutes (absorption time and temperature raising time 90 min). Peracid treatment was performed using formic acid to which 0.5% hydrogen peroxide had been added. Pulp consistency in peracid washing was 20%. Pulp kappa number after peracid washing and water washings was 27.5.

The pulp was bleached with alkaline pressure peroxide bleaching at 105° C. for 35 minutes (temperature raising time 30 min) at a pressure of 4.5 bar, the final pH being 9.0. Brightness in the first stage was 67.5% ISO and viscosity 1282. The second peroxide pressure bleaching was performed at 110° C. for 60 minutes (temperature raising time 15 min), the final pH being 10.5. After the second bleaching, brightness was 90.1% ISO and viscosity 1101. The third peroxide bleaching stage was performed at 110 to 115° C. for 30 minutes (temperature raising time was 50 min). Brightness was 91.8% and viscosity 1038. In all stages DTPA (0.2%) and $MgSO_4$ (0.5%) were used.

Total hydrogen peroxide consumption in the three bleaching stages was 4.3% of the amount of pulp with a pH range of 9.2 to 10.4.

What is claimed is:

1. A method based on single-stage formic acid cooking for producing pulp with a high brightness, the method comprising the stages of:

(a) dignifying cellulose raw material in single-stage cooking with formic acid, possibly together with other organic acids, at a temperature of 105–135° C., (b) removing cooking liquor from the delignified pulp and washing the pulp with formic acid using a multiple-stage washing sequence, (c) removing the formic acid and possibly other organic acids from the washed pulp, and (d) bleaching the pulp by using oxidizing bleaching chemicals, wherein the last formic acid washing stage in the multiple-stage washing sequence of stage (b) comprises washing the pulp, free from cooking liquor and in a medium or high consistency state, with formic acid containing performic acid produced in situ and possibly other peracids.

2. A method as claimed in claim 1, wherein the performic acid used in the last formic acid washing stage of stage (b) is prepared immediately in situ or immediately before use by adding hydrogen peroxide or ozone to formic acid.

3. A method as claimed in claim 2, wherein the amount of hydrogen peroxide used for the preparation of performic acid in the last formic acid washing stage of stage (b) is 0.01 to 1.5% of the amount of cellulose raw material.

4. A method as claimed in claim 3, wherein the amount of hydrogen peroxide used for the preparation of performic acid in the last fonnic acid washing stage of stage (b) is 0.2 to 1% of the amount of cellulose raw material.

5. A method as claimed in claim 1, wherein the performic acid treatment in the last formic acid washing stage of stage (b) is performed at a temperature of 50 to 90° C.

6. A method as claimed in claim 5, wherein the pulp is washed in stage (b) in a counter-current wash using as washing liquid formic acid which is recylced from the performic acid treatment in the last formic acid washing stage of stage (b) and which contains possibly other organic acids, residual peracid and other peracids.

7. A method as claimed in claim 5, wherein the performic acid treatment in the last formic acid washing stage of stage (b) is performed at a temperature of 60 to 80° C.

8. A method as claimed in claim 1, wherein pulp consistency in the last formic acid washing stage of stage (b) is 10 to 50% dry matter.

9. A method as claimed in claim 8, wherein pulp consistency in the last formic acid washing stage of stage (b) is 20 to 35% dry matter.

10. A method as claimed in claim 1, wherein the bleaching in stage (d) comprises alkaline hydrogen peroxide bleaching or combined oxygen and hydrogen peroxide bleaching.

11. A method as claimed in claim 10, wherein the bleaching in stage (d) comprises multiple stages to provide a target brightness.

12. A method as claimed in claim 11, wherein said bleaching in stage (d) comprises from 1 to 4 stages.

13. A method as claimed in claim 12, wherein said bleaching in stage (d) comprises 2 to 4 stages.

14. A method as claimed in claim 10, wherein said bleaching in stage (d) is pressure bleaching.

15. A method as claimed in claim 1, wherein the delignifing stage (a) is performed at a temperature of 110 to 125° C.

* * * * *

UNITED STATES PATENT AND TRADEMARK OFFICE
CERTIFICATE OF CORRECTION

PATENT NO. : 6,156,156

DATED : December 5, 2000

INVENTOR(S) : Rousu et al.

It is certified that error appears in the above-identified patent and that said Letters Patent is hereby corrected as shown below:

Title page, [57] ABSTRACT, line 8, before "chlorine" cancel "a".

Column 5, lines 40-41, cancel "The process diagram shown in the attached FIGURE illustrates the operation of the method of the invention.".

Column 7, line 20, "dignifying" should read --delignifying--.

Column 8, line 5, "fonnic" should read --formic--; lines 37-38, "delignifing" should read --delignifying--.

Signed and Sealed this

First Day of May, 2001

*Attest:*

Nicholas P. Godici

NICHOLAS P. GODICI

*Attesting Officer*

*Acting Director of the United States Patent and Trademark Office*